United States Patent [19]

Furse et al.

[11] Patent Number: 4,693,328

[45] Date of Patent: Sep. 15, 1987

[54] EXPANDABLE WELL DRILLING TOOL

[75] Inventors: John H. Furse; Praful C. Desai, both of Kingwood; Charles H. Dewey, Houston, all of Tex.

[73] Assignee: Smith International, Inc., Newport Beach, Calif.

[21] Appl. No.: 871,767

[22] Filed: Jun. 9, 1986

[51] Int. Cl.[4] ..... E21B 17/10

[52] U.S. Cl. ..... 175/273; 175/325

[58] Field of Search ..... 389/29, 50; 166/241; 175/325, 373, 275, 267, 269

[56] References Cited

U.S. PATENT DOCUMENTS

| | | | |
|---|---|---|---|
| 3,425,500 | 2/1969 | Fuchs | 175/269 |
| 3,476,196 | 11/1969 | Whittle et al. | 175/273 |
| 4,133,396 | 1/1979 | Tschirky | 175/57 |
| 4,133,397 | 1/1974 | Tschirky | 175/57 |
| 4,231,437 | 11/1980 | Swusky et al. | 175/325 |

*Primary Examiner*—Stephen J. Novosad

*Assistant Examiner*—Thomas J. Odar

*Attorney, Agent, or Firm*—Christie, Parker & Hale

[57] ABSTRACT

A three roller centralizer is expandable from a position with the rollers retracted to a position with the rollers extended to a larger diameter for remaining concentric in a hole being underreamed. A diagonal camming surface is fixed on the body above each such roller. An axially shiftable diagonal camming surface is mounted on a piston below each such roller. Application of hydraulic pressure on the piston squeezes the rollers outwardly toward their extended position. After the rollers are fully extended, the lower camming surface can travel further so that axially extending surfaces above and below each roller prevent collapse of the rollers toward the retracted position. Links pivotably interconnect the carrier for such a roller and the body and lower camming surface respectively for retaining the rollers. Such a link has an elongated opening so that the carrier can move along the diagonal and axially extending surfaces instead of being limited to a circular path.

33 Claims, 5 Drawing Figures

EXPANDABLE WELL DRILLING TOOL

FIELD OF THE INVENTION

This invention concerns a tool useful when underreaming an oil well or the like. In one embodiment the tool is an expandable centralizer for maintaining an underreamer in the center of a well bore.

BACKGROUND

When drilling an oil well or the like, it is common practice to start with a relatively large diameter hole and cement surface casing in the hole. Subsequent drilling is conducted through this casing. As drilling progresses deeper in the well, the diameter of the hole drilled may be reduced in steps, and progressively smaller diameters of casing may be set in the well at increasing depth. Generally speaking it is desirable to drill as deep as possible with a given hole diameter so that smaller sizes are available for drilling beyond unanticipated problem depths without reducing the hole diameter below a desired size.

A drill bit must pass through the casing in the wall above the depth of drilling. Thus, it is essential that the drill bit have a smaller diameter than the smallest casing already set in the well. It is also important that the hole drilled have a diameter larger than the outside diameter of the next casing to be placed in the well bore. It is desirable to maintain a small clearance between the outside of the casing and the well bore since it is less costly to drill a small hole than a large hole. A small clearance may also permit the use of smaller casing at higher elevations in the hole for a given completion diameter, thereby significantly reducing the total cost of drilling and completing a well.

It is desirable to have as small a difference as possible between the diameters of successive lengths of casing set in the hole. If so, for a given diameter at the completion depth, a larger number of size steps can be provided between the ground surface and the completion depth, or a smaller diameter can be used for the surface casing. Either of these can be of substantial benefit. The use of smaller surface casing is particularly advantageous in undersea well completions. Thus, it is desirable to have a tight fit of casing in a bore hole.

When providing a relatively close fit between a bore hole and casing, it can often be desirable to underream a portion of a well bore to provide a sufficient annulus between the casing and bore hole to inject cement for cementing a portion of the casing in place. There are a variety of other reasons that it is sometimes desirable to underream a well bore.

When a well bore is underreamed, an expandable drilling tool is introduced through the casing to the elevation where underreaming is desired. At that point the underreamer is expanded to drill the rock formation to a larger diameter than the hole through which the underreamer passed. Such underreaming can be in a hole that is already drilled, in which case a bullnose or the like is used as a pilot on the underreamer to maintain it centered in the hole being reamed. In other circumstances the hole is reamed as it is drilled, in which case a rockbit or the like is placed ahead of the underreamer to drill the hole simultaneously with reaming. The rock bit tends to maintain the underreamer centralized in the hole being reamed.

When a short distance is being reamed in a bore hole, a relatively stiff drill string and conventional stabilizers can be employed above the underreamer for assisting in maintaining it centralized in the well bore. When a long distance is being reamed, there has not previously been any apparatus available for centralizing the underreamer from above. Conventional stabilizers are not usable in the underreamed portion of the hole.

Most underreamers have three expandable arms mounted on the underreamer body for supporting the cutters that ream the hole. Geometric constraints limit the increase in diameter that can be reamed with such a tool. It can, therefore, be desirable to employ underreamers with two expandable arms which can have a larger ratio between open and closed diameters.

Such a two-arm underreamer can be made quite stout for obtaining a high penetration rate and prolonged lifetime for underreaming a substantial depth of hole. Such a two-arm underreamer is somewhat more difficult to maintain centralized in a hole, particularly when high drilling weights are applied for maintaining a high penetration rate.

It is therefore desirable to provide an expandable centralizer for use in a drill string above an underreamer. Such an expandable centralizer preferably has a closed diameter approximately the same as that of the underreamer and an open diameter similar to that of the underreamer for maintaining the underreamer centralized in the hole.

The structure of an expandable centralizer preferably provides a high ratio between the expanded and retracted diameters to accommodate underreaming where the underreamer has a high diameter ratio. Preferably the centralizer is positively secured in its open or expanded position to prevent inadvertent collapse during underreaming. It is also desirable that the centralizer be biased toward collapsing to the retracted position when raised in the well bore from the larger diameter portion to the smaller diameter portion to enhance closing of the centralizer.

It is preferable that the centralizer have rollers for engaging the wall of the well so that a high proportion of the torque applied to the drill string is available for underreaming instead of being wasted in friction.

It can also be desirable that similar structure be adaptable to use as a reamer for helping maintain gage in a hole being underreamed, or similar structure may be adaptable for use as an underreamer.

BRIEF SUMMARY OF THE INVENTION

There is, therefore, provided in practice of this invention according to a presently preferred embodiment, an expandable well drilling tool having an elongated body with well wall engaging elements mounted for movement between a radially retracted position for passing through a smaller diameter of a well bore and a radially extended position for maintaining concentricity in an underreamed portion of a well bore. The upper end of the body is preferably threaded for connection to a drill string and the lower end may be threaded for connection to an underreamer or other well drilling apparatus. The wall engaging element if cammed from the retracted position toward the extended position by means of a first camming means fixed on the body and a second camming means axially shiftable along the body toward the first camming means, thereby squeezing the wall engaging element toward the extended position.

Movable links may be used for connecting the wall engaging element with the body and second camming means. Preferably the tool has means for preventing movement of the wall engaging element inwardly toward the retracted position when the axially shiftable camming means is shifted to its limit toward the fixed camming means.

DRAWINGS

These and other features and advantgages of the invention will be appreciated as the same becomes better understood by reference to the following detailed description when considered in connection with the accompanying drawings wherein.

DESCRIPTION

Figure 3:
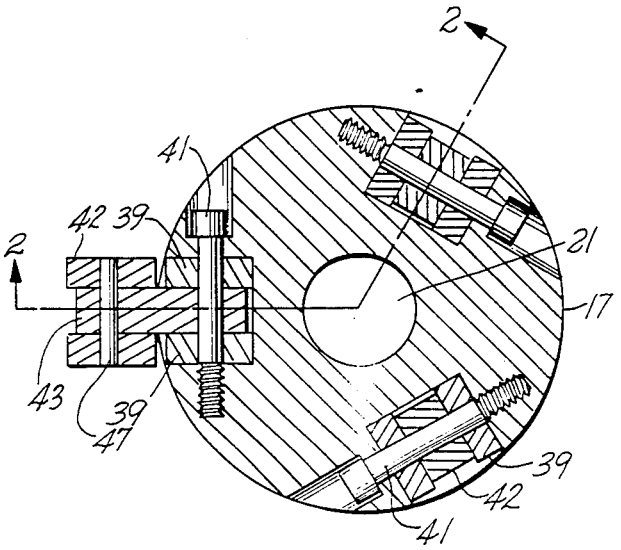
FIG. 3 is a transverse cross section of the centralizer at line 3—3 of FIG. 2 with one of the wall engaging elements of the centralizer being in its expanded position and the other two being in the retracted position.
Figure 4:
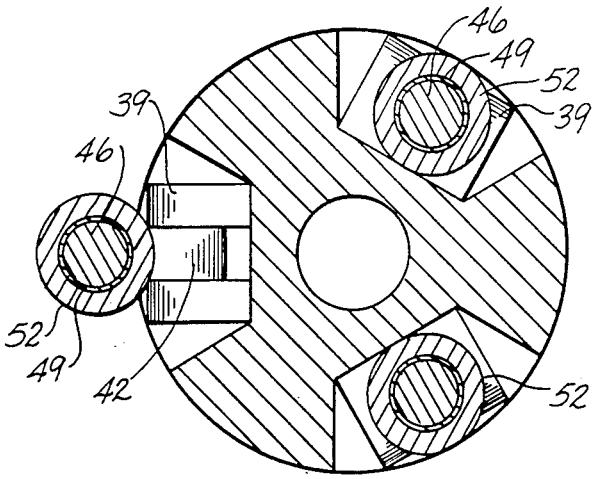
FIG. 4 is a transverse cross section at line 4—4 of FIG. 2 with one wall engaging element expanded and the other two retracted.

In an exemplary embodiment for underreaming a well bore, a centralizer 10 is connected at its upper end to a conventional pipe drill string 11 and at its lower end to an expandable underreamer 12. The centralizer can be connected directly to the underreamer or a drill collar or pup sub can be in between them. In the arrangement illustrated in FIG. 1 a conventional bullnose is connected at the lower end of the underreamer. A drill bit could be used instead. In the left hand side of this drawing both the underreamer and centralizer are shown expanded and on the right side they are each retracted. Similarly, in FIG. 2 the centralizer is shown in its expanded position in the left half of the cross section and retracted in the right half. Similar combined positions are shown in FIGS. 3 and 4. This is, of course, solely for purposes of illustration, and in use the centralizer and underreamer are either completely retracted or completely expanded.

Figure 1:
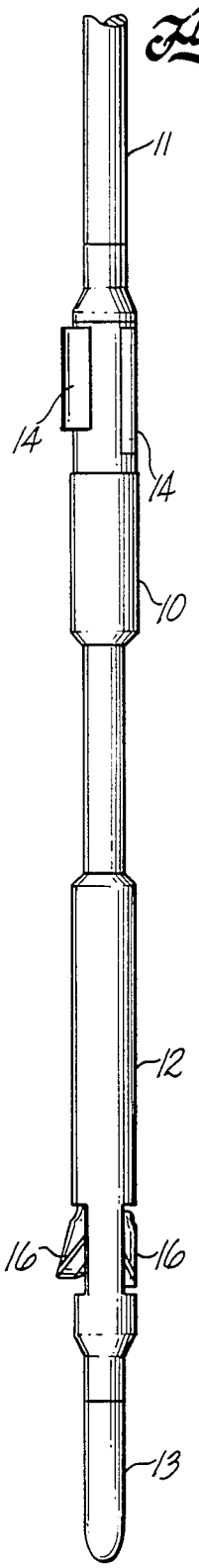
FIG. 1 illustrates a centralizer mounted in a drill string with an exemplary underreamer.
Figure 2:
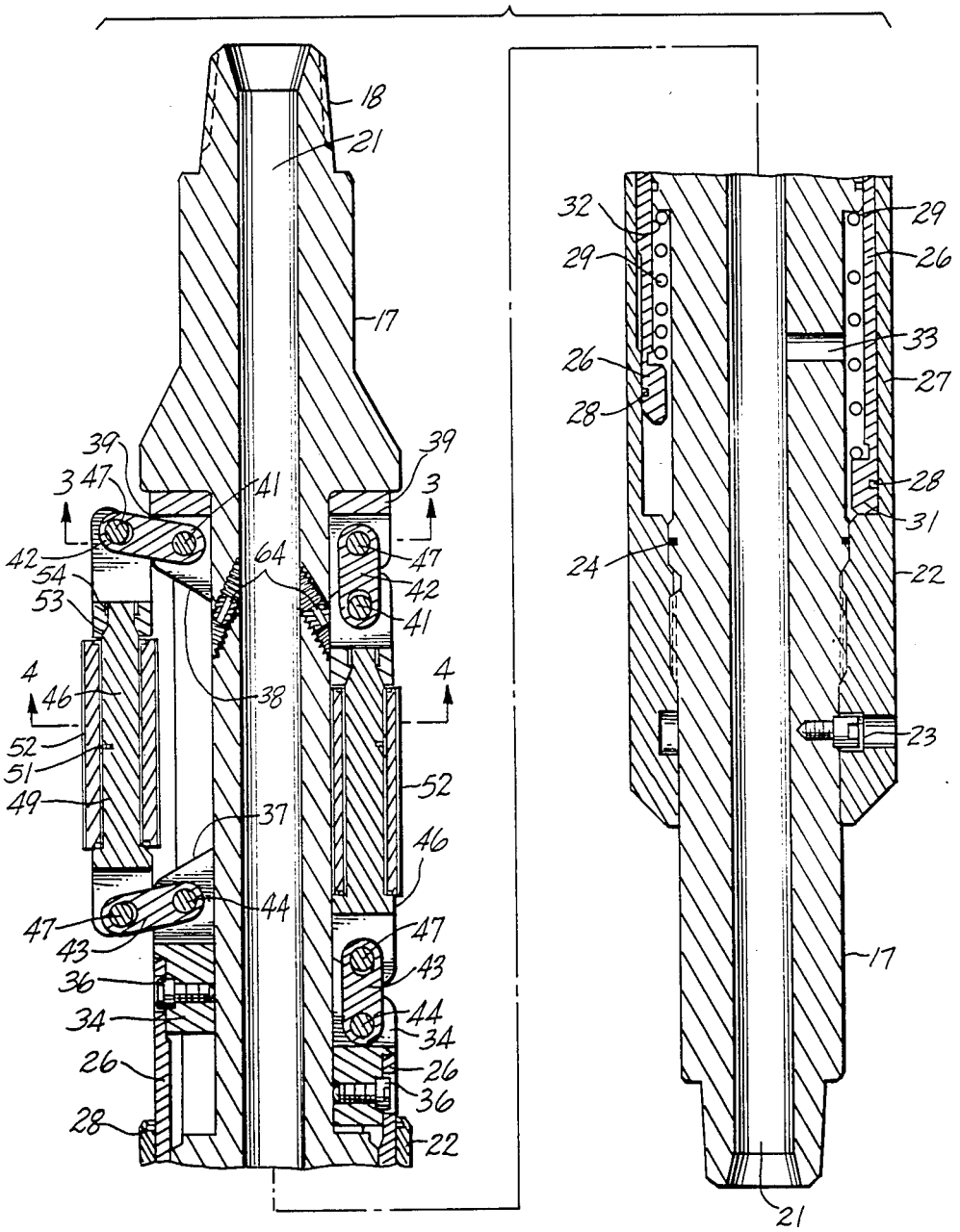
FIG. 2 is a longitudinal cross section of the centralizer, with the left half of the illustration showing the centralizer in the expanded position and the right half of the illustration showing the centralizer in its retracted position.

In a preferred embodiment the centralizer has three wall engaging elements 14 indicated schematically by rectangles in FIG. 1. These wall engaging elements are arranged 120° apart around the centralizer. Three such elements engaging the walls of the well bore maintain the centralizer concentric in the well. This is particularly significant when the centralizer is used in combination with an underreamer having two diametrically opposite expandable arms 16. Exemplary two-arm underreamers are described and illustrated in U.S. Pat. No. 3,817,339 and in U.S. Patent Application Ser. No. 789,388, filed Oct. 21, 1985, and assigned to the same assignee as this invention. The three elements of the centralizer engaging the wall substantially assist in maintaining the concentricity of the two-arm underreamer. This is also of significance in an application where a drill bit is connected below the underream instead of a bullnose. In that situation the three-arm stabilizer helps minimize hole deviation.

The centralizer has a generally cylindrical steel body 17 having conventional threads 18 at its upper end for connection to the drill string. The body of the centralizer also has threads 19 at its lower end for connection to an underreamer or the like. In the embodiment illustrated in FIG. 2 the threads 18 and 19 are male threads, however, it will be apparent that female threaded ends are equally applicable.

An annular cylinder 22 is threaded onto the body of the centralizer. A plurality of cap screws 23 prevent the cylinder from unscrewing from the body. The lower portion of the cylinder is sealed to the body by an O-ring 24. An annular piston 26 fits into the annular space between a skirt 27 of the cylinder and the steel body 17 of the centralizer. Packings 28 seal the piston to the sleeve and body. A spring 29 between a head 31 on the piston and a shoulder 32 on the body biases the piston downwardly toward the position it has when the wall engaging elements of the centralizer are retracted as illustrated in the right half of FIG. 2.

A bore 21 extends through the centralizer for conveying drilling mud or the like through the centralizer to other tools further down hole.

A lateral passage 33 extends between the bore and the annular space between the body and cylinder within which the piston 26 is located. Thus, when drilling mud or the like is pumped down the drill string through the bore, the drilling mud applied hydraulic pressure against the piston, thereby urging the piston upwardly toward the position in which the wall engaging elements are shifted to their expanded location, as shown on the left half of the cross section shown in FIG. 2.

As mentioned above, there are three wall engaging elements circumferentially spaced around the centralizer. At each of these locations there is a lower cam 34 connected to the upper end of the piston by a cap screw 36. The upper end of the lower cam has an outwardly sloping camming surface 37. Opposed to this camming surface is an oppositely sloping camming surface 38 on an upper cam block 39, which is secured to the body of the centralizer by a shoulder bolt 41.

The upper cam and lower cam are each generally U-shaped at the end opposite from the camming surface. A movable link 42, 43 is positioned in each of these U-shaped openings. Each link is generally FIG. 8-shaped, being elongated with semicircular ends and having two transverse holes for receiving bolts or pins.

The upper link 42 is secured to the body by the shoulder bolt 41 passing through one of the holes. The lower link 43 is connected to the lower cam by a transverse cam pin 44 through one of the holes. The lower link is also connected to the U-shaped lower end of a lower carrier 46 by a transverse carrier pin 47 through the other hole. Another transverse carrier pin 47 connects the upper link to a U-shaped upper carrier 48. The lower carrier has an axially extending journal on which is positioned a cylindrical steel bushing 49. In a preferred embodiment the bushing is formed with a small flange at each end to carry a thrust load, and is cut in half for assembly on the carrier. If desired an oil impregnated bronze bushing can be used to provide a lubricated bearing surface. A cylindrical steel roller 52 having a conventional carburized case on its outer surface is mounted on the bushing. If desired the roller can have hard facing on its outer surface, or inserts of cemented tungsten carbide may be pressed into the roller for contacting the formation surrounding the well bore.

The upper end of the lower carrier journal has a conical seat 53 that mates with a complementary conical seat in the upper carrier. A cylindrical carrier nut 54 is threaded onto the end of the lower carrier to keep the conical seats in engagement. (The carrier nut is installed with a spanner wrench.)

The lower end of the lower carrier has a diagonal camming surface 56 (FIG. 5) complementary to the diagonal camming surface 37 on the lower cam. Similarly the upper carrier has a diagonal camming surface 57 complementary to the camming surface 38 on the upper cam. These cams are spaced far enough apart that the assembled carriers fit between them as illustrated on the right half of the cross section in FIG. 2. It will be apparent that when the piston moves upwardly, closing the gap between the lower and upper cams, the camming surfaces squeeze the assembled carriers laterally outwardly toward an extended position as illustrated on the left in FIG. 2 and in FIG. 5.

The stroke of the piston is sufficiently long that when the piston is in its uppermost (roller extended) position, the camming surfaces 37 and 38 on the cams are closer together than the camming surfaces 56 and 57 on the assembled carriers. Thus, as the carriers are squeezed outwardly they eventually reach a radial position where the camming surfaces are no longer in engagement. As the lower cam moves still closer to the upper cam, a radially inner, axially extending face 58 on the lower carrier overrides a radially outer, axially extending face 59 on the lower cam, and an inner face 61 on the upper carrier overrides an outer face 62 on the upper cam.

Figure 5:
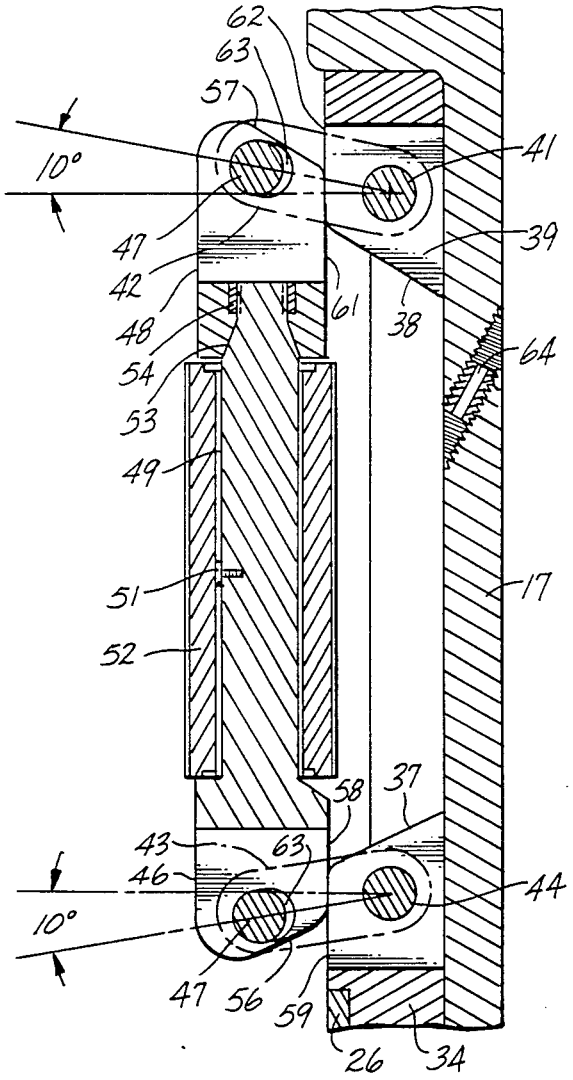
FIG. 5 illustrates in fragmentary longitudinal cross section an extended wall engaging element in somewhat larger scale.

One of the holes 63 in each of the links 42 and 43 in which the carrier pins 47 fit is somewhat elongated so that as the links rotate around the shoulder bolt 41 and cam pin 44, the carrier pins and hence, the carriers are not forced to follow a circular arc. Instead the upper carrier, for example, first moves in a straight path with the camming surfaces 38 and 57 in engagement, and then moves in an axially extending straight path with the inner and outer surfaces 61 and 62 in engagement. The lower carrier follows a similar path with respect to the camming surface 37 and outer axial face 59. The engagement of the axial faces 58, 59, 61 and 62 buttresses the carriers against forces applied by the hole wall and prevents the carriers from being pressed inwardly when they have been moved to their extended position as illustrated in FIG. 5. The stroke of the piston is sufficient that after the carriers have been squeezed completely out of the space between the cams, the lower cam, travels to a position where the distance between the shoulder bolt 41 and cam pin 44 is less than the distance between the two carrier pins 47. This means that the links 42 and 43 pass "over center". The relative dimensions are such that the upper link 42 is at an angle of about 10° beyond a radial plane through the axis of the shoulder bolt 41. Similarly, the lower link 43 is about 10° beyond a radial plane through the axis of the cam pin 44. This assures that the bearing areas of the axial faces are sufficient to carry the radially applied loads on the rollers as the centralizer is used. Having the links travel over center also helps in preventing collapse of the centralizer.

When an expandable centralizer is used, it is sent down the well bore on a drill string without application of mud pressure. Thus, the piston is in its lowermost position and the rollers are retracted. When drilling mud pressure is applied, the piston is urged upwardly so that the rollers are urged outwardly by the squeezing action of the camming surfaces. If the centralizer is in a portion of the hole that has not yet been reamed so that it is at a smaller diameter than the fully expanded diameter of the rollers, the rollers merely engage the wall of the hole and roll thereon as the centralizer is rotated. When the rollers enter a portion of the hole that has been underreamed to the expanded diameter of the rollers, the rollers are squeezed outwardly to their full extended position and are effectively locked there by the axially extending faces on the carriers and cams. The rollers engage the walls of the enlarged bore hole and keep the centralizer concentric within it. Thus, since the rollers are mounted with their axes approximately parallel to the centralizer axis, they can roll on the hole wall whether retracted or extended, or at some intermediate position.

Most of the force acting on the rollers merely rotate them on the bearing bushings. There is relatively little up-hole load. In the event there is up-hole loading, there is no tendency to close the centralizer since the carriers are merely pushed upwardly and are restrained by the upper link 42.

When drilling mud pressure is cut off, the hydraulic force urging the piston toward its upper extended position is relaxed. The spring then biases the piston toward its lower retracted position, carrying the lower cam with it. After the lower cam has travelled over center past the lower carrier pin, it commences pulling the carriers downwardly until the axially extending surfaces on the carriers and cams disengage, and the carriers are free to move radially inwardly along the camming surfaces.

Small mud nozzles 64 are provided for directing drilling mud from within the bore 21 into the space between the cams when the rollers are in the extended position. Introduction of drilling mud into these pockets behind the rollers can help avoid caking of material in the pockets that would inhibit retraction of the rollers.

In the event the piston does not move freely downwardly, the centralizer can be lifted until the upper carrier engages the non-underreamed portion of the bore hole. This pressure on the upper carrier can add to the spring force tending to push the lower cam downwardly. Up and down motion in the hole may free stuck parts and promote retraction of the wall engaging rollers.

It might be noted that the force tending to bias the piston downwardly is greatest when the piston is in its uppermost position and the spring is maximally compressed. In the event the force exerted by the spring as it expands is insufficient to move the piston to its lowermost position due to friction and the like, uphole motion by the centralizer against an unreamed portion of the bore hole can be added to the spring force to bias the lower cam downwardly and complete closing of the centralizer. Radial wedging of the carriers between the cams can also be of assistance in closing the centralizer.

If desired, movement of the piston downwardly can be biased by an upwardly extending bar connected to the upper end of the piston and extending to about the upper end of the upper carrier when it is in its extended position. Such a bar can contact an unreamed portion of the bore hole and press the piston downwardly. A cam on the body causes such a bar to extend laterally from the body when the piston is in its upper position and collapse inwardly to clear the well bore when the piston is in its lower position.

In an exemplary embodiment the total length of the centralizer is in the range of from 8 to 10 feet, and the diameter when the wall engaging rollers are retracted diameter, exemplary extended diameters are 15 inches and 17½ inches. The extended diameter is readily altered by changing the wall engaging roller assemblies.

When reaming a large diameter hole (e.g., 17½ inches), particularly when the hole is at a high angle from vertical, it can be of considerable importance to stabilize the underreamer. In a high angle hole, the weight of the drill string places a high transverse load on the underreamer. This tends to fatigue tool joints and critical portions of the underreamer as the drill string is rotated. By placing a centralizer above the underreamer, the bending moment applied by the drill string can be avoided. In an application where a drill bit is employed below the underreamer rather than following a predrilled hole, the bending by the drill string can cause substantial hole deviation. Use of a centralizer above the underreamer can mitigate this problem as well.

It is sometimes desirable to underream long lengths of bore hole; sometimes from, 2000 to 5000 feet of hole may be underreamed. When a long hole of large diameter is being underreamed, there can be "flopping" of the drill string in the hole as it rotates. This is very hard on the joints in the drill string and high stresses are applied to the drill string and underreamer. In such an embodiment a plurality of centralizers as provided in practice of this invention may be spaced along the length of the drill string to maintain it concentric in the hole being reamed.

When a series of such centralizers are used, drilling mud pressure is applied to the pistons of all of them. Those that have entered the underreamed portion of the hole are expanded so that the wall engaging rollers are fully extended. Those centralizers that remain in an unreamed portion of the bore hole are biased outwardly with a moderate force by the mud pressure. They can remain in the largely retracted position indefinitely without harm to either the centralizer or bore hole, and will expand to the fully extended position when the larger underreamed portion of the bore hole is reached.

In the illustrated embodiment carburized steel rollers are used to engage the walls of the bore hole as the centralizer is used. It will be apparent that if desired an integral member could be used in lieu of the upper and lower carriers with a hard faced outer wear pad surface which merely rubs against the walls of the bore hole. In other words, a wear pad can be used instead of a roller for engaging the hole walls. An exemplary hard facing comprises granular cemented tungsten carbide particles distributed in a matrix of brazing alloy. Carburized steel or other hard facing materials, or tungsten carbide inserts can be used as desired.

It will also be apparent that the structure of the centralizer can be adapted to be used as an expandable rotary reamer. In such an embodiment the rollers are replaced with conventional cutters. An exemplary cutter is basically cylindrical with a plurality of teeth on the periphery of the cylinder. The lower end of the cutter is tapered to provide gradual engagement of the cutter with the rock formation being reamed. Such a reamer may be used, for example, to enlarge a hole that has been underreamed a quarter inch or so under gage.

Another variety of roller usable in a rotary reamer has a plurality of cemented tungsten carbide inserts pressed into radially extending holes in the roller. Such inserts engage rock formation at the wall of the well bore to crush the rock and enlarge the bore to a desired gage.

In still another embodiment the basic structure of the centralizer can be adapted to form an expandable drag type reamer. In such an embodiment an integral member is mounted between the links in lieu of two carriers. Generally radially extending holes are bored in such a member and hard inserts are pressed into the holes for engaging the walls of the well bore and scraping formation from, the walls for enlarging the well bore to a desired gage. Exemplary hard inserts having a layer of polycrystalline diamond on a cemented tungsten carbide stud are illustrated in U.S. Pats. Nos. 4,109,737 and 4,186,628, among many other such patents. Tungsten carbide or other hard materials may also be used, if desired, for inserts for reaming a well bore to gage.

In the illustrated embodiment the camming means at each end of the wall engaging roller has opposing ramps and there are complementary ramps on the carriers. It will be apparent that a similar type of squeezing action for urging the rollers from the retracted toward the extended position can be obtained without full complementary surfaces. For example, opposing ramps can be employed as camming surfaces on the cams and the follower portion on the carriers can be in the form of somewhat rounded ends on the carriers. Conversely, opposed ramps can be provided on the ends of the carriers and the cams can be rounded for following the camming surfaces on the carriers. It will also be apparent that the magnitude of the force tending to urge the rollers toward their extended positions can be predetermined by the angle of the camming surfaces.

It will also be apparent that other piston arrangements may be used for causing drilling mud to squeeze the wall engaging elements of the centralizer toward an extended position. However, it is preferred that the piston move upwardly so that the lower cam is movable and the upper cam is fixed. This may assist in closing the centralizer since gravity and force against the unreamed portion of the hole are favorably oriented. It is possible, if desired, to employ two pistons so that both the upper and the lower diagonal camming surfaces can wedge themselves between the body and carrier for squeezing the rollers outwardly. An annular piston is also desirable to obtain a large differential area with minimal increase in diameter.

Many other modifications and variations will be apparent to one skilled in the art and it is therefore to be understood that within the scope of the appended claims the invention may be practiced otherwise than as specifically described.

What is claimed is:

1. An expandable well drilling tool comprising:
   - an elongated generally cylindrical body;
   - means at an upper end of the body for connection to a drill string;
   - a well wall engaging element mounted on the body for movement between a radially retracted position at least in part within the body and a radially extended position at least in part outside the body;
   - first camming means fixed on the body for camming the wall engaging element from the retracted position toward the extended position;
   - second camming means for camming the wall engaging element from the retracted position toward the extended position, the wall engaging element being between the first and second camming means in the retracted position; and means for shifting the second camming means axially along the body toward the first camming means for squeezing the wall engaging element toward the extended position.

2. A tool as recited in claim 1 wherein the camming means comprises:

a first camming surface on the body;

follower means at a first end of the wall engaging element for engaging the first camming surface; and second axially shiftable follower means at the second end of the wall engaging element for engaging the second camming surface.

3. A tool as recited in claim 1 wherein the first and second camming means each comprise a ramp and said ramps slope away from each other in the radially outward direction and follower means on the wall engaging element for engaging each of said ramps.

4. A tool as recited in claim 1 wherein the wall engaging element comprises a roller having an axis parallel to the tool axis.

5. A tool as recited in claim 1 further comprising means for preventing movement of the wall engaging element inwardly toward the retracted position when the axially shiftable camming means is shifted to its limit toward the first camming means.

6. A tool as recited in claim 5 wherein the means for preventing movement inwardly comprises:

a first axially extending, outwardly facing surface on the body beyond the first camming means;

a second axially extending, outwardly facing surface beyond the axially shiftable second camming means;

a first axially extending, inwardly facing surface on the wall engaging element for engaging the first outwardly facing surface on the body; and a second axially extending, inwardly facing surface on the wall engaging element for engaging the second outwardly facing surface on the axially shiftable second camming means.

7. A tool as recited in claim 6 further comprising:

a first link pivotably connecting one end of the wall engaging element to the body adjacent to the first camming means; and a second link pivotably connecting the other end of the wall engaging element to the axially shiftable camming means.

8. A tool as recited in claim 7 wherein each of the links is sufficiently long to pivot through more than 90° between the element retracted position and the element extended position.

9. A tool as recited in claim 7 wherein each of the links is generally FIG. 8-shaped with two transverse holes for receiving pin means for connecting the links as recited in claim 7, and wherein at least one of the holes is elongated.

10. An expandable well drilling tool comprising:

an elongated generally cylindrical body; means at an upper end of the body for connecting the body to a drill string;

a plurality of wall engaging elements mounted on the body, each of the elements comprising:

a roller;

means for shifting the roller between a first retracted position at least in part inside the body and a second extended position at least partly radially outwardly from the body comprising:

an upper camming surface above the roller;

a similar but oppositely facing lower camming surface below the roller; and means for axially shifting one of the camming surface for symmetrically squeezing the roller from the retracted position toward the extended position; and means for mounting the roller so that its axis remains approximately parallel to the body axis upon shifting between the retracted and extended positions.

11. A tool as recited in claim 10 comprising an annular piston on the body connected to the lower camming surface and means for applying drilling fluid pressure on the piston for shifting the lower camming surface.

12. A tool as recited in claim 10 further comprising means for preventing collapse of the rollers toward the retracted position when the shiftable camming surface is axially shifted to its limit toward the other camming surface.

13. An expandable well drilling tool comprising:

an elongated generally cylindrical body;

means at an upper end of the body for connection to a drill string;

a plurality of rotary elements, the axes of which remain approximately parallel to the body axis upon shifting between a first retracted position at least in part within the body and a second extended position at least in part extending radially outwardly from the body;

buttress means for preventing such a rotary element from shifting from the extended position toward the retracted position; and a first wedging surface fixed on the body and a second wedging surface axially shiftable on the body for symmetrically squeezing such rotary element toward the extended position.

14. A tool as recited in claim 13 comprising:

a first link pivotably connected at one end to an end of the rotary element and pivotably connected at its other end to the body for connecting the end of the rotary element to the body; and a second link having one end pivotably connected to the other end of the rotary element and its other end pivotably connected adjacent the axially shiftable wedging surface.

15. A tool as recited in claim 14 wherein each link comprises an elongated opening in at least one end for accommodating noncircular travel of an end of the rotary element relative to the connection between the link and body.

16. An expandable metal well drilling tool comprising:

an elongated generally cylindrical body; means at the upper end of the body for connecting the tool to a drill string;

a plurality of wall engaging elements mounted on the body for movement between a retracted position at least in part within the body and an extended position at least in part radially outward from the body, each of the wall engaging elements comprising:

a roller mounted on an axis approximately parallel to the body axis;

a carrier having tapered ends longer on an outer portion and shorter on an inner portion;

axial compression means for squeezing the carrier radially outwardly toward its extended position; and buttress means for preventing return of the carrier to it retracted position.

17. A tool as recited in claim 16 wherein the buttress means comprises axially extending surfaces above and below the roller.

18. An expandable well drilling tool comprising:

an elongated generally cylindrical body; means at the upper end of the body for connecting the tool to a drill string;

a plurality of wall engaging elements mounted on the body for movement between a retracted position at least in part within the body and an extended position at least in part radially outward from the body, each of the wall engaging elements comprising:

a carrier having tapered ends longer on an outer portion and shorter on the inner portion;

an annular piston on the body means for applying hydraulic pressure to the piston from within the body for axially shifting the piston for squeezing the carrier radially outwardly toward its extended position; and buttress means for preventing return of the carrier to its retracted position.

19. A tool as recited in claim17 wherein the piston is axially shiftable from a lower position when the elements are retracted to an upper position when the elements are extended.

20. An expandable centralizer comprising:

an elongated generally cylindrical body;

means at each end of the body for connecting the centralizer into a drill string;

an axial passage through the body;

an annular piston mounted on the body for shifting axially between a retracted position and an extended position;

means for introducing fluid from the passage through the body to an end of the piston for shifting the piston from the retracted position toward the extended position;

a first camming means connected to the piston;

a second camming means on the body opposed to the first camming means;

a carrier extending between the first and second camming means and having a cam follower at each end for engaging the opposed first and second camming means;

a wall engaging roller mounted on the carrier; and a first link pivotably interconnecting the carrier and the body and a second link pivotably interconnecting the carrier and first camming means for retaining the carrier on the centralizer.

21. A centralizer as recited in claim 20 wherein the first camming means comprises a camming surface extending diagonally relative to the axis of the body and the second camming means comprises a camming surface extending diagonally relative to the axis of the body opposite to the first camming surface.

22. A centralizer as recited in claim21 wherein each of the cam followers comprises a diagonally extending surface complementary to the first and second camming surfaces respectively.

23. A centralizer as recited in claim 21 further comprising an axially extending outwardly facing surface beyond the first diagonal camming surface;

a second axially extending outwardly facing surface on the body beyond the second diagonal camming surface; and inwardly facing axially extending surfaces on the carrier for engaging the outwardly facing surfaces and preventing shifting of the carrier from the extended position toward the retracted position.

24. A centralizer as recited in claim 23 wherein the inwardly facing surfaces engage the outwardly facing surfaces when the piston is in its extended position.

25. A centralizer as recited in claim 24 wherein the outer ends of the links are further apart than the inner ends of the links when the roller and piston are in their extended position.

26. A centralizer as recited in claim 25 wherein each link comprises an elongated opening for accommodating noncircular travel of an end of the carrier relative to the camming means.

27. A centralizer as recited in claim 20 wherein the retracted position of the piston is relatively lower on the body and the extended position of the piston is relatively higher on the body.

28. A centralizer as recited in claim 27 further comprising:

an annular cylinder on the outside of the body and wherein the piston is mounted in an annulus between the body and cylinder; and spring means for biasing the piston toward the retracted position.

29. An expandable centralizer comprising:

an elongated body;

means at each end of the body for connecting the centralizer into a drill string;

a pair of opposed camming surfaces extending diagonally relative to the length of the body;

a carrier between the camming surfaces having follower surfaces at each end for engaging the camming surfaces and being displaced radially outwardly in response to advance of such a camming surface;

an axially extending surface at each end of the carrier;

an axially extending surface adjacent each camming surface for maintaining the carrier in its extended position; and means on the carrier for engaging the wall of a well bore.

30. An expandable centralizer as recited in claim 29 wherein the means for engaging the wall of a well bore comprises a roller mounted on the carrier with its axis approximately parallel to the axis of the body.

31. An expandable centralizer as recited in claim 29 further comprising a pair of links pivotably interconnecting the carrier and the camming surfaces for retaining the carrier on the centralizer.

32. A centralizer as recited in claim 31 wherein each link comprises an elongated opening for accommodating noncircular travel of an end of the carrier relative to the camming means.

33. An expandable centralizer as recited in claim 31 wherein the outer ends of the links connected to the carrier are a greater distance apart than the inner ends of the links connected to the camming surfaces when the carrier is cammed to its radially outward position.

* * * * *

UNITED STATES PATENT AND TRADEMARK OFFICE

CERTIFICATE OF CORRECTION

PATENT NO. : 4,693,328

DATED : September 15, 1987

INVENTOR(S) : John H. Furse, Praful C. Desai, Charles H. Dewey

It is certified that error appears in the above-identified patent and that said Letters Patent is hereby corrected as shown below:

In the Claims, Column 9, Line 56, "FIG. 8-shaped" should be -- figure 8-shaped --.

Signed and Sealed this

Nineteenth Day of April, 1988

*Attest:*

DONALD J. QUIGG

*Attesting Officer*

*Commissioner of Patents and Trademarks*